US009738568B1

(12) United States Patent
Lambert et al.

(10) Patent No.: US 9,738,568 B1
(45) Date of Patent: Aug. 22, 2017

(54) METHODS AND SYSTEMS FOR AN EXPLOSIVE CORD

(71) Applicant: Goodrich Corporation, Charlotte, NC (US)

(72) Inventors: Jerry A. Lambert, Dixon, CA (US); Luis G. Interiano, Galt, CA (US)

(73) Assignee: GOODRICH CORPORATION, Charlotte, NC (US)

( * ) Notice: Subject to any disclaimer, the term of this patent is extended or adjusted under 35 U.S.C. 154(b) by 0 days.

(21) Appl. No.: 15/074,334

(22) Filed: Mar. 18, 2016

(51) Int. Cl.
*C06C 5/04* (2006.01)
*F42C 19/02* (2006.01)

(52) U.S. Cl.
CPC ..... *C06C 5/04* (2013.01); *F42C 19/02* (2013.01)

(58) Field of Classification Search
CPC .... C06C 5/04; C06C 5/06; C06C 5/00; C06C 5/08; F42D 1/043; F42D 1/04; E21B 43/1185
USPC ..... 102/275.1, 275.8
See application file for complete search history.

(56) References Cited

U.S. PATENT DOCUMENTS 3,896,731 A * 7/1975 Kilmer ..... F42C 19/0846 102/305
4,080,902 A * 3/1978 Goddard ..... C06C 5/04 102/200
4,083,305 A * 4/1978 Garrison ..... C06C 5/04 102/275.8
5,144,893 A 9/1992 Zeman et al.
5,223,664 A 6/1993 Rogers et al.
7,971,532 B1 7/2011 Olson et al.

OTHER PUBLICATIONS http://www.explosivestraining.com/au/Signal_Tube.htm; "Explosives Training Australia Signal Tube Information", Mar. 7, 2010; all pages.*

* cited by examiner

*Primary Examiner* — Samir Abdosh
(74) *Attorney, Agent, or Firm* — Snell & Wilmer, L.L.P.

(57) ABSTRACT

Methods and systems for an explosive cord are disclosed. An explosive cord may comprise a tubing comprising an inner surface and an outer surface, a reactive material comprising hexanitrostilbene and/or boron potassium nitrate coupled to the inner surface of the tubing, and a hollow or solid core through the center of the explosive cord.

8 Claims, 4 Drawing Sheets

METHODS AND SYSTEMS FOR AN EXPLOSIVE CORD

FIELD

The present disclosure relates generally to explosive cords.

BACKGROUND

Explosive cords are employed in aerospace and other applications for transferring an explosive signal from one location to another. Explosive cords are also employed in providing precise delays or timing relationships between different energetic reactions which are initiated by the explosive signal. Current explosive cord designs for the ignition of rockets or missiles typically include an interrupter to be built into the cord. An interrupter adds complexity and cost to the design and production of explosive cords.

SUMMARY

In various embodiments, an explosive cord may comprise a tubing comprising an inner surface and an outer surface, a reactive material comprising hexanitrostilbene coupled circumferentially to the inner surface of the tubing, and a hollow core through the center of the explosive cord, the hollow core being defined by the reactive material. The tubing may comprise a polymeric material.

In various embodiments, the explosive cord may comprise an outer layer coupled circumferentially to the outer surface of the tubing, which may comprise a metal material. The outer layer may comprise steel. In various embodiments, the tubing may comprise a fluoropolymer, such as poly ethylene chlorotrifluoroethylene. In various embodiments, the reactive material may comprise aluminum. The reactive material may comprise between 70% and 100% by weight hexanitrostilbene.

In various embodiments, a method of manufacturing an explosive cord may comprise melting a polymeric material, extruding the polymeric material through a die, creating a tubing comprising an inner surface and an outer surface, and/or applying a reactive material to the inner surface of the tubing, wherein the reactive material comprises hexanitrostilbene.

In various embodiments, melting the polymeric material may comprise a fluoropolymer such as poly ethylene chlorotrifluoroethylene. Extruding the polymeric material may occur at a temperature between 250° C. and 280° C. In various embodiments, applying the reactive material to the inner surface of the tubing may occur simultaneously with extruding the polymeric material.

In various embodiments, an explosive cord may comprise a core, comprising a reactive material and a flammable material, and a tubing comprising a tubing outer edge and a tubing inner edge. The reactive material may comprise boron potassium nitrate and the reactive material may be coupled to a flammable material outer edge. The tubing inner edge may be coupled to the core.

In various embodiments, the flammable material may comprise cotton. In various embodiments, the core may comprise a plurality of strands of the flammable material. The reactive material may comprise an adhesive. In various embodiments, the tubing may comprise polypropylene and/or a fluoropolymer such as poly ethylene chlorotrifluoroethylene and/or polytetrafluoroethylene.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

All ranges may include the upper and lower values, and all ranges and ratio limits disclosed herein may be combined. It is to be understood that unless specifically stated otherwise, references to "a," "an," and/or "the" may include one or more than one and that reference to an item in the singular may also include the item in the plural.

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, and mechanical changes may be made without departing from the scope of the disclosure. Thus, the detailed description herein is presented for purposes of illustration only and not of limitation. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

Figure 1:
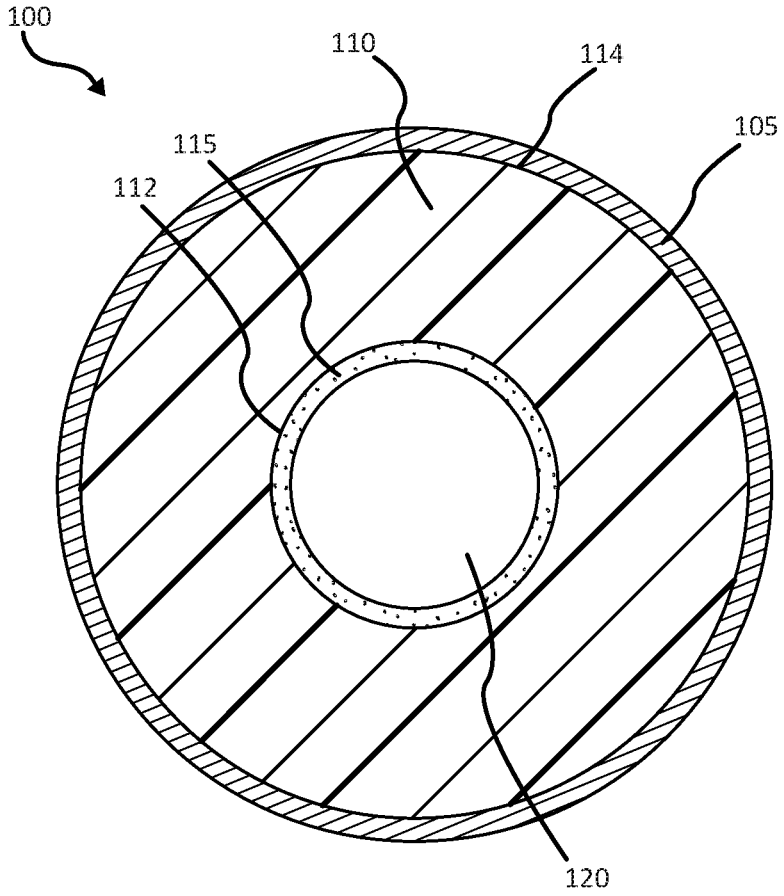
FIG. 1 illustrates a schematic cross-section view of an explosive cord configured to detonate, in accordance with various embodiments.

Referring to FIG. 1, a cross section of an explosive cord 100 configured to detonate is illustrated, in accordance with various embodiments. In various embodiments, explosive cord 100 may comprise an outer layer 105, tubing 110, a reactive material 115, and/or a hollow core 120 through the center of explosive cord 100. Tubing 110 may comprise a radially inner surface 112 and a radially outer surface 114. Outer layer 105 may be circumferentially coupled to outer surface 114 of tubing 110, and may be the radially outwardmost component of explosive cord 100. In various embodiments, explosive cord 100 may comprise no outer layer 105. Reactive material 115 may be circumferentially coupled to inner surface 112 of tubing 110. Hollow core 120 may be defined by reactive material 115 and/or tubing 110.

In various embodiments, outer layer 105 may be comprised of any material that is suitable to provide abrasion protection and tensile strength along the length and circumference of explosive cord 100, for example, steel (including stainless steel) and/or any other suitable material. In various embodiments, tubing 110 may be comprised of a polymeric material or any other suitable material. For example, tubing 110 may comprise a fluoropolymer including polytetrafluoroethylene ("PTFE") and/or a copolymer of ethylene and chlorotrifluoroethylene (e.g., poly ethylene chlorotrifluoroethylene) available commercially as HALAR®. In various embodiments, tubing 110 may be comprised of other suitable materials, such as polypropylene, polyethylene, polyolefin, polyurethane, and/or the like. Tubing 110 may have any cross-sectional shape, such circular, square, rectangular, triangular, etc.

In various embodiments, reactive material 115 may be a pulverulent material and may be any material that is able to propagate a pressure wave and hot gas through a length of explosive cord 100, causing a thin layer detonation through hollow core 120 of explosive cord 100. For example, reactive material 115 may comprise hexanitrostilbene (HNS). In various embodiments, an adhesive resin may be comprised in reactive material 115 to aid in coupling reactive material 115 to tubing 110. In various embodiments, reactive material 115 may comprise a mixture of HNS and a metal. Reactive material 115 may comprise between 70% and 100% by weight HNS and between 0% and 30% by weight metal. In various embodiments, a nominal loading of about 21.6 mg/meter HNS and about 2.2 mg/meter metal is used in explosive cord 100. These values may vary depending on the diameter of the space in explosive cord 100 comprising hollow core 120 plus reactive material 115. As used in this context, the term "about" only refers to plus or minus 1 mg/meter. In various embodiments, reactive material 115 comprises a mixture of about 91% by weight HNS and about 9.2% by weight metal. As used in this context, the term "about" only refers to plus or minus 2% by weight. The metal comprised in reactive material 115 may be any suitable metal such as metallic aluminum, titanium, boron, steel, zirconium, iron, and/or the like. The shape of the particles of the metal may be spherical, flake-shaped, acicular, needle-shaped, or any other suitable shape. Particles of HNS in reactive material 115 may be between about 12 microns and about 20 micron. As used in this context, the term "about" only refers to plus or minus 2 microns.

In various embodiments, tubing 110 may comprise poly ethylene chlorotrifluoroethylene (i.e., HALAR®), which melts at a temperature between 200° C. (392° F.) and 227° C. (441° F.) and has a recommended oven processing temperature range between 250° C. (482° F.) and 280° C. (536° F.). "Processing" the polymeric material, as used herein, may comprise melting the polymeric material (such as poly ethylene chlorotrifluoroethylene), preparing the polymeric material for manipulation into new forms, and/or extruding the polymeric material. The reactive material in an explosive cord may comprise octogen (also known as HMX), which has an ignition onset temperature of around 274° C. (525° F.). When manufacturing an explosive cord comprising HMX as the reactive material, the poly ethylene chlorotrifluoroethylene may not be processed within the recommended oven processing temperature range of 250° C. (482° F.) and 280° C. (536° F.) because of the risk of reaching 274° C. (525° F.) and igniting the HMX. The ignition onset temperature of HNS, on the other hand, is around 320° C. (608° F.), which is preceded by an endothermic melt that occurs around 317° C. (603° F.). Therefore, the poly ethylene chlorotrifluoroethylene in tubing 110 may be properly processed within the recommended temperature range without risk of igniting the HNS. Additionally, the exotherm that forms as a result of the endothermic melt of HNS at 317° C. (603° F.) adds a conservable safety margin. The use of HNS also allows a greater safety margin between the ignition onset temperature of HNS and the melting and/or processing temperatures of other polymeric materials, such as PTFE, for example.

Figure 2:
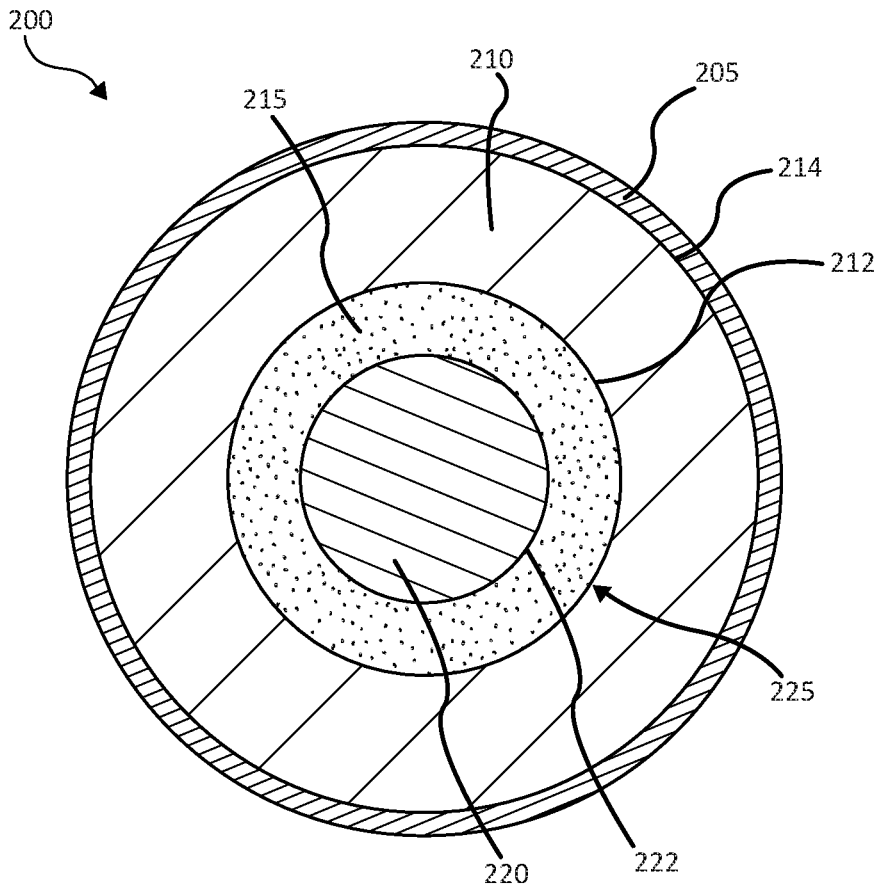
FIG. 2 illustrates a cross-section view of an explosive cord configured to deflagrate, in accordance with various embodiments.

Referring to FIG. 2, a cross section of an explosive cord 200 configured to deflagrate is illustrated, in accordance with various embodiments. In various embodiments, explosive cord 200 may comprise an outer layer 205, a tubing 210, a reactive material 215, and/or a flammable material 220 through the center of explosive cord 200. Tubing 210 may comprise a radially inner edge 212 and a radially outer edge 214. Outer layer 205 may be coupled circumferentially to outer edge 214 of tubing 210, and may be the radially outward-most component of explosive cord 200. In various embodiments, explosive cord 200 may comprise no outer layer 205.

In various embodiments, outer layer 205 may be comprised of any material that is suitable to provide abrasion protection and tensile strength along the length and circumference of explosive cord 200, for example, steel (including stainless steel) and/or any other suitable material. In various embodiments, tubing 210 may be comprised of a polymeric material or any other suitable material. For example, tubing 210 may comprise polypropylene, polyethylene, polyolefin, polyurethane, a fluoropolymer, and/or any other suitable material. A fluoropolymer may include PTFE and/or a copolymer of ethylene and chlorotrifluoroethylene (e.g., poly ethylene chlorotrifluoroethylene) available commercially as HALAR®. Tubing 210 may have any cross-sectional shape, which may be circular, square, rectangular, triangular, or any other suitable shape. In various embodiments, flammable material 220 may comprise any flammable material such as cotton.

In various embodiments, reactive material 215 may be a pulverulent material and may be any material that is able to propagate a pressure wave and hot gas through a length of explosive cord 200, causing a deflagration through explosive cord 200. For example, reactive material 215 may comprise boron potassium nitrate (BPN). In various embodiments, an adhesive resin may be comprised in reactive material 215 to aid in coupling reactive material 215 to tubing 210 and/or flammable material 220. In various embodiments, reactive material 215, in response to igniting, may produce a gas pressured of 200 pounds per square inch (psi) (1379 kPa). In various embodiments, explosive cord 200 may comprise about 3240 mg/meter BPN, which may produce about 5178 calories/meter (21.665 kJ/meter) and/or 0.0466 moles of gas per meter. In various embodiments, explosive cord 200 may comprise about 6472 mg/meter BPN, which may produce about 10356 calories/meter (43.330 kJ/meter) and/or 0.0932 moles of gas per meter. As used in this context, the term "about" only refers to plus or minus 50 mg, 200 calories/meter (836.8 J/meter), and/or 0.01 moles of gas per meter, respectively.

In various embodiments, flammable material 220 and reactive material 215 may be comprised in a core 225 of explosive cord 200. Tubing 210 may be coupled circumferentially to core 225 and/or reactive material 215. In various embodiments, core 225 may comprise a single strand of flammable material 220, such as cotton, and reactive material 215 may be coupled circumferentially to flammable material 220 at a flammable material outer edge 222. Flammable material 220 may be in the center of explosive cord 200. In various embodiments, core 225 may comprise a plurality of strands of flammable material 220. In various embodiments, core 225 may comprise three strands of flammable material 220. Reactive material 215 may be coupled to one or more of the plurality of strands of flammable material 220. The plurality of strands of flammable material 220, which may have reactive material 215 coupled to one or more of them, may be coupled together to form core 225.

Traditionally, materials more sensitive and reactive than HNS and BPN have been used in explosive cords, such as HMX and black powder. After ignition of the reactive material, such sensitive, reactive materials may be able to better jump gaps in the reactive material along an explosive cord in order to keep the explosive signal traveling through the explosive cord. HMX and black powder may also be more commercially available than HNS and BPN. However, because reactive materials such as HMX and black powder are sensitive and easily ignited, their use in explosive cords for rockets and missiles requires an interrupter in the explosive cord as a safety precaution. HNS and BPN are less reactive, less sensitive materials than HMX and black powder, but are still capable of providing an explosive signal through an explosive cord without as great a risk of accidental ignition. Therefore, HNS and BPN are safer reactive materials. Accordingly, by using HNS in explosive cord 100 and BPN in explosive cord 200 as the reactive materials, explosive cord 100 and explosive cord 200, if used for the ignition of rockets and/or missiles, could be done so without an interrupter as a safety feature.

Figure 3:
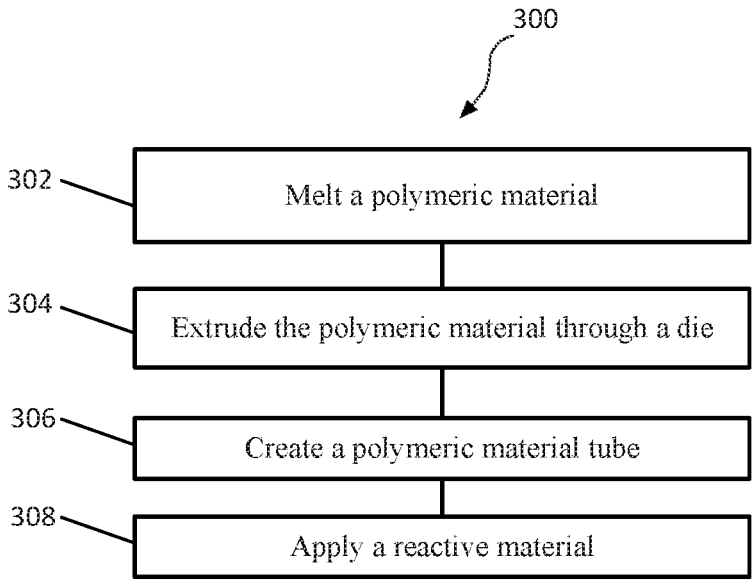
FIG. 3 illustrates a method of manufacturing an explosive cord configured to detonate, in accordance with various embodiments.

Referring to FIG. 3, an exemplary method of manufacturing an explosive cord configured to detonate is depicted, in accordance with various embodiments. With combined reference to FIGS. 1 and 3, a polymeric material may be processed, which first may include the polymeric material being melted (step 302). The polymeric material may comprise a fluoropolymer, such as poly ethylene chlorotrifluoroethylene. In various embodiments, wherein the polymeric material comprises poly ethylene chlorotrifluoroethylene, for example, the processing may comprise melting the polymeric material at a temperature between 200° C. (392° F.) and 227° C. (441° F.), and/or oven processing the polymeric material at a temperature between 250° C. (482° F.) and 280° C. (536° F.). The polymeric material may be further processed by being extruded through a die (step 304). The extrusion may occur at a temperature between 250° C. (482° F.) and 280° C. (536° F.). The die may be circular, rectangular, triangular, oval, or any other suitable shape to form a cord. In response to the extrusion, a tube of polymeric material, such as tubing 110, may be created (step 306), which may have any suitable shape. A reactive material 115 may be applied (step 308) to the inner surface 112 of the tubing. Reactive material 115 may comprise HNS. In various embodiments, the polymeric material may be extruded simultaneously with the application of the reactive material to the inner surface 112 of the tubing.

Figure 4:
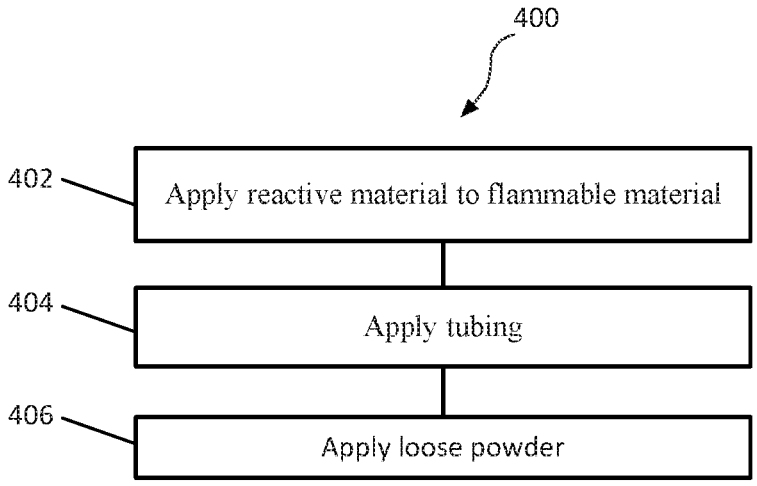
FIG. 4 illustrates a method of manufacturing an explosive cord configured to deflagrate, in accordance with various embodiments.

Referring to FIG. 4, an exemplary method of manufacturing an explosive cord configured to deflagrate is depicted, in accordance with various embodiments. A reactive material 215 may be applied to a flammable material 220 (step 402) to form core 225. Reactive material 215 may be dispersed in a solvent and be applied to flammable material 220. In various embodiments, as discussed herein, reactive material 215 may be applied to one strand of flammable material 220 to form core 225, or reactive material 215 may be applied to a plurality of strands of flammable material 220. The plurality of strands of flammable material 220 may be coupled together to form core 225. The solvent in which reactive material 215 is dispersed may be removed. Flammable material 220 may comprise cotton or any other suitable flammable material. The reactive material may comprise BPN. A tubing 210 may be applied (step 404) circumferentially to core 225. Tubing 210 may be any suitable material as discussed herein. In various embodiments, tubing 210 may be wrapped around flammable material 220 and/or reactive material 215. In various embodiments, tubing material may be melted and extruded through a die as reactive material 215 is applied. In various embodiments, loose powder of reactive material 215 may be applied (step 406) to explosive cord 200 being manufactured before, during, or after, tubing material is being applied through extrusion.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Systems, methods and apparatus are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An explosive cord, comprising:

a tubing, comprising polymeric material, the tubing comprising an inner surface and an outer surface;

a reactive material comprising hexanitrostilbene coupled circumferentially to the inner surface of the tubing; and a hollow core through a center of the explosive cord, the hollow core being defined by the reactive material.

2. The explosive cord of claim 1, further comprising an outer layer coupled circumferentially to the outer surface of the tubing.

3. The explosive cord of claim 2, wherein the outer layer comprises a metal material.

4. The explosive cord of claim 3, wherein the outer layer comprises steel.

5. The explosive cord of claim 1, wherein the tubing comprises a fluoropolymer.

6. The explosive cord of claim 5, wherein the tubing comprises poly ethylene chlorotrifluoroethylene.

7. The explosive cord of claim 1, wherein the reactive material further comprises aluminum metal.

8. The explosive cord of claim 7, wherein the reactive material comprises between 70% and 100% by weight hexanitrostilbene.

* * * * *